US006741913B2

(12) United States Patent
Wang et al.

(10) Patent No.: US 6,741,913 B2
(45) Date of Patent: May 25, 2004

(54) TECHNIQUE FOR NOISE REDUCTION IN A TORQUE-BASED CHEMICAL-MECHANICAL POLISHING ENDPOINT DETECTION SYSTEM

(75) Inventors: Xinhui Wang, Poughkeepsie, NY (US); Yingru Gu, Poughkeepsie, NY (US); Leping Li, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 232 days.

(21) Appl. No.: 10/013,196

(22) Filed: Dec. 11, 2001

(65) Prior Publication Data

US 2003/0109194 A1 Jun. 12, 2003

(51) Int. Cl.[7] ..... G05B 13/00
(52) U.S. Cl. ..... 700/275; 156/345.13; 451/5
(58) Field of Search ..... 451/5, 6, 41; 700/275; 216/88; 438/693; 156/345.13

(56) References Cited

U.S. PATENT DOCUMENTS 5,069,002 A 12/1991 Sandhu et al.
5,433,651 A * 7/1995 Lustig et al. ..... 451/6
5,722,875 A * 3/1998 Iwashita et al.
5,736,462 A * 4/1998 Takahashi et al.
5,830,041 A 11/1998 Takahashi et al.
5,846,882 A 12/1998 Birang
5,876,265 A 3/1999 Kojima
6,042,454 A 3/2000 Watanabe et al.
6,102,775 A 8/2000 Ushio et al.
6,179,688 B1 1/2001 Beckage et al.
6,190,234 B1 2/2001 Swedek et al.
6,213,846 B1 4/2001 Li et al.
6,257,953 B1 7/2001 Gitis et al.
6,271,047 B1 8/2001 Ushio et al.
6,293,845 B1 * 9/2001 Clark-Phelps ..... 156/345.13
6,402,589 B1 * 6/2002 Inaba ..... 451/41
6,614,540 B1 * 9/2003 Stirton ..... 356/630

OTHER PUBLICATIONS

Appl. No. 09/689,361 (FIS9–98–184)—Filed Oct. 12, 2000, entitled "Real–Time Control of Chemical–Mechanical Polishing Processes using a Shaft Distortion Measurement".

* cited by examiner

*Primary Examiner*—Albert W. Paladini
(74) *Attorney, Agent, or Firm*—Jay H. Anderson

(57) ABSTRACT

A method is described for noise reduction in a CMP endpoint detection system employing torque measurement. The torque signals are acquired using an adjustable sampling rate and sample size, and averaged using a moving array of adjustable size. By introducing these three adjustable quantities in the torque-based endpoint control algorithm and properly setting their values in the endpoint detection recipe, periodic noise associated with carrier rotation and carrier oscillation can be effectively removed. This in turn permits reliable, closed-loop control of the CMP process.

16 Claims, 8 Drawing Sheets

TECHNIQUE FOR NOISE REDUCTION IN A TORQUE-BASED CHEMICAL-MECHANICAL POLISHING ENDPOINT DETECTION SYSTEM

FIELD OF THE INVENTION

This invention relates to semiconductor processing, and more particularly to noise reduction in the detection of the endpoint for removal of a film by chemical-mechanical polishing.

BACKGROUND OF THE INVENTION

In the manufacture of integrated circuits, the selective formation and removal of films on an underlying substrate are critical steps. Chemical-mechanical polishing (CMP) has become a widely used process for selective film removal and for planarizing a structure where a patterned film overlies another film.

In film removal processes such as CMP, it is extremely important to stop the process when the correct film thickness has been removed (that is, when the endpoint has been reached). In a typical CMP process, a film is selectively removed from a semiconductor wafer by rotating the wafer against a polishing pad (or moving the pad against the wafer, or both) with a controlled amount of pressure in the presence of a slurry. Overpolishing (removing too much) of a film renders the wafer unusable for further processing, thereby resulting in yield loss. Underpolishing (removing too little) of the film requires that the CMP process be repeated, which is tedious and costly. Underpolishing may sometimes go unnoticed, which also results in yield loss.

FIG. 1 shows a typical CMP apparatus 10 in which a workpiece 100 (such as a silicon wafer) is held face down by a wafer carrier 11 and polished using a polishing pad 12 located on a polishing table or platen 13; the workpiece is in contact with slurry 14. The wafer carrier 11 is rotated by a shaft 15 driven by a motor 16.

An example of an important CMP process is shown in FIGS. 2A and 2B. This process involves removal of a polycrystalline silicon (poly-Si) film overlying a patterned film of silicon dioxide ($SiO_2$) or silicon nitride ($Si_3N_4$); after removal of a blanket layer of poly-Si, a surface having partly poly-Si and partly $SiO_2$ or $Si_3N_4$ is be exposed. In FIG. 2A, a patterned oxide layer 102 is covered by a layer 104 of poly-Si. Generally, it is necessary to remove the target film of poly-Si down to a level 105 so as to completely expose the oxide pattern, while leaving the oxide layer itself essentially intact (FIG. 2B). A successful endpoint detection scheme must detect exposure of the patterned layer with very high sensitivity, and automatically stop the CMP process within a few seconds after that layer becomes exposed. The endpoint detection scheme should also be effective regardless of the pattern factor of the wafer (that is, even if the area of the exposed underlying pattern is a small portion of the total wafer area).

One widely used approach to monitor and control a CMP process is to monitor a change in the motor current associated with a change in friction between (a) the top surface of the polishing pad 12 and (b) the slurry 14 and the surface being polished (such as the surface of wafer 100). This method is satisfactory when there is a significant change in friction as the underlying layer is exposed. However, for many applications, including the poly-Si polishing process described just above, the change in friction associated with the interface between layers is too small to result in a motor current change sufficient to be a reliable indicator of CMP process endpoint. This problem is aggravated by a large noise component in the motor current associated with the typical feedback servo current used to drive the wafer carrier at a constant rotational speed. In addition, a small pattern factor (that is, a relatively small area of the underlying patterned layer, compared with the area of the target layer) causes only a small change in friction as the endpoint is reached, limiting the useful signal.

A convenient and highly sensitive method of endpoint detection, applicable to CMP equipment such as shown in FIG. 1, is described in U.S. application Ser. No. 09/689,361, "Real-time control of chemical-mechanical polishing processes using a shaft distortion measurement," the disclosure of which is incorporated herein by reference. According to this method, changes in friction between the surface of the wafer 100 and the polishing pad 12, in the presence of the slurry 14, are monitored by directly monitoring the deformation of the carrier shaft 15. During a polishing process, the shaft 15 driving the wafer carrier 11 can experience changes in torque, bending, thrust and tension. Torque on the shaft (for example, due to rotation by motor 16 in direction 31 being opposed by frictional forces in direction 32) will induce deformation of the shaft, as shown schematically in FIG. 3. The degree of deformation depends on the diameter of the shaft, with smaller-diameter shafts being more susceptible to deformation. Such deformations can be measured with extremely high sensitivity at reasonable cost.

When an underlying film of a different material is exposed during the CMP process (for example, when the polishing of layer 104 exposes surface 105; see FIG. 2B), the accompanying change in friction results in a change in torque experienced by the shaft 15. The change in torque induces a change in deformation of the shaft, which is measured by a strain gauge 201 bonded to (or embedded in) the shaft, as shown in FIG. 4. Strain gauge 201 is connected to a transmitter 202 which broadcasts a signal 203 to a detector 210. The signal 203 indicates strain caused by deformation of the shaft 15, which in turn is directly related to torque experienced by the shaft. This arrangement therefore generates a signal indicating changes in friction between the polishing pad 12 and slurry 14 and the wafer 100. Signals acquired by detector 210 are then processed and analyzed in signal processing unit 220, which produces an endpoint signal. Processing unit 220 typically includes a computer with a storage medium, the storage medium having software stored therein for performing the endpoint detection algorithm. The endpoint signal may be fed to a control unit 250 to stop the CMP process.

FIG. 5A shows an example of a detected torque signal 51 acquired and processed during polishing of a poly-Si layer. The sharp change in the signal indicates that the interface between layers has been reached. The actual amount of torque on the shaft may vary from one polishing process to the next, so that a specific value of torque indicating the endpoint cannot be fixed. It therefore is preferable to detect the CMP endpoint in accordance with a change in the torque, as opposed to a predetermined value of torque. This is done by calculating the time derivative 52 of the torque signal (see FIG. 5B); the peak of the derivative is used to indicate the process endpoint. It is noteworthy that this technique provides real-time, in situ endpoint monitoring and permits closed-loop control of the CMP process.

Since the endpoint signal is based on measurement of the change in torque associated with interaction among the wafer 100, slurry 14 and pad 12, the endpoint signal varies with the rotation and oscillation of the wafer carrier 11. As shown in FIG. 6A, shaft 15 causes wafer carrier 11 to rotate with respect to pad 12 (fixed to platen 13) while carrier 11 oscillates across the pad surface. FIG. 6B is a top view of the apparatus of FIG. 6A, showing the platen 13 and wafer carrier 11. The wafer carrier rotates about shaft 15 in direction 61, and oscillates along a radius of the platen in directions 62*a* and 62*b*. At a given point in time, the amount of torque on the shaft 15 depends on the angular position of the shaft and on the location of the carrier 11 on its radial trajectory. The torque thus varies periodically according to the separate rotation and oscillation periods. These periodic variations in the torque can be great enough to cause false endpoint signals. This noise cannot be eliminated by using a low/high pass filter or a band pass filter, since the noise generally is in the same frequency region as the true endpoint signal.

It is possible to remove the noise associated with carrier rotation by using a phase-sensitive detection scheme, using timing signals from additional sensors embedded in shaft 15. However, this approach adds cost and complexity to the endpoint detection equipment, and may introduce sources of additional noise. Introducing hardware to reduce the noise associated with carrier oscillation leads to similar difficulties. (Noise associated with rotation 65 of the platen 13 has not been found to be significant.)

There remains a need for a noise reduction technique applicable to a torque-based CMP endpoint detection scheme. It is desirable that such a technique minimize added complexity in the endpoint detection apparatus, and preferably not add any hardware to the apparatus.

SUMMARY OF THE INVENTION

The present invention addresses the above-described need by providing a noise reduction method for CMP endpoint detection, including an adjustable sampling rate, sample size, and moving array size for analyzing torque signals. By introducing these three adjustable quantities in the torque-based endpoint control algorithm and properly setting their values in the endpoint detection recipe, the periodic noises associated with carrier rotation and carrier oscillation can be effectively removed. This in turn permits reliable, closed-loop control of the CMP process.

According to a first aspect of the invention, a method is provided for reducing noise in a CMP endpoint detection system where measurements associated with friction between the polishing pad and the workpiece are performed. In a first computing step, a plurality of values are computed at a predetermined time interval t, given by $t=t_s+t_p$ where $t_s$ and $t_p$ are data sampling and processing times respectively. Each of these computed values is an average of a plurality of measurements performed in time period $t_s$, approximately equal to a rotation period of the workpiece carrier. An array is then formed which includes successive values computed in the first computing step, and which includes the most recently computed value. The array has a maximum size given by a moving array size, determined by approximating the product of the moving array size and the time interval to an integral multiple of an oscillation period of the carrier. In a second computing step, an average of the values in the array is computed, to obtain an array average at each successive time interval.

The measurements may be characterized by a sampling rate; after the rotation period is established, at least one of the sampling rate and a number of the measurements is set so that a sampling time for performing the measurements approximates the rotation period. The array includes all of the computed values when the number of computed values does not exceed the moving array size.

In accordance with the invention, a CMP endpoint signal may be obtained as follows: A plurality of successive array averages are computed and plotted to obtain a function of time. The derivative of this function with respect to time is then calculated, to yield an endpoint signal.

The above-described method is applicable to measurements of torque on the shaft connected to the wafer carrier. Alternatively, the method may be applied to measurements of current in the motor used to drive the shaft.

According to another aspect of the invention, the CMP apparatus includes a computer-readable storage medium; the medium has stored thereon instructions for performing a method as described above.

The noise reduction method of the present invention is effective in removing noise associated with carrier rotation and oscillation, without requiring any additional hardware.

DETAILED DESCRIPTION OF THE PREFERRED EMBODIMENTS

The noise associated with rotation and oscillation of the wafer carrier 11 may be effectively eliminated by averaging out the noise over the respective periods of rotation and oscillation $T_{rot}$ and $T_{osc}$. This is done by introducing tunable parameters into the endpoint detection algorithm and adjusting those parameters in accordance with the actual polishing conditions. It should be noted that this involves modification only of software in the data analysis unit 220; the CMP equipment and the endpoint detection hardware (the actual sources of the noise) are not affected.

Rotation Noise: Tunable Sampling Rate and Sample Size

Figure 1:
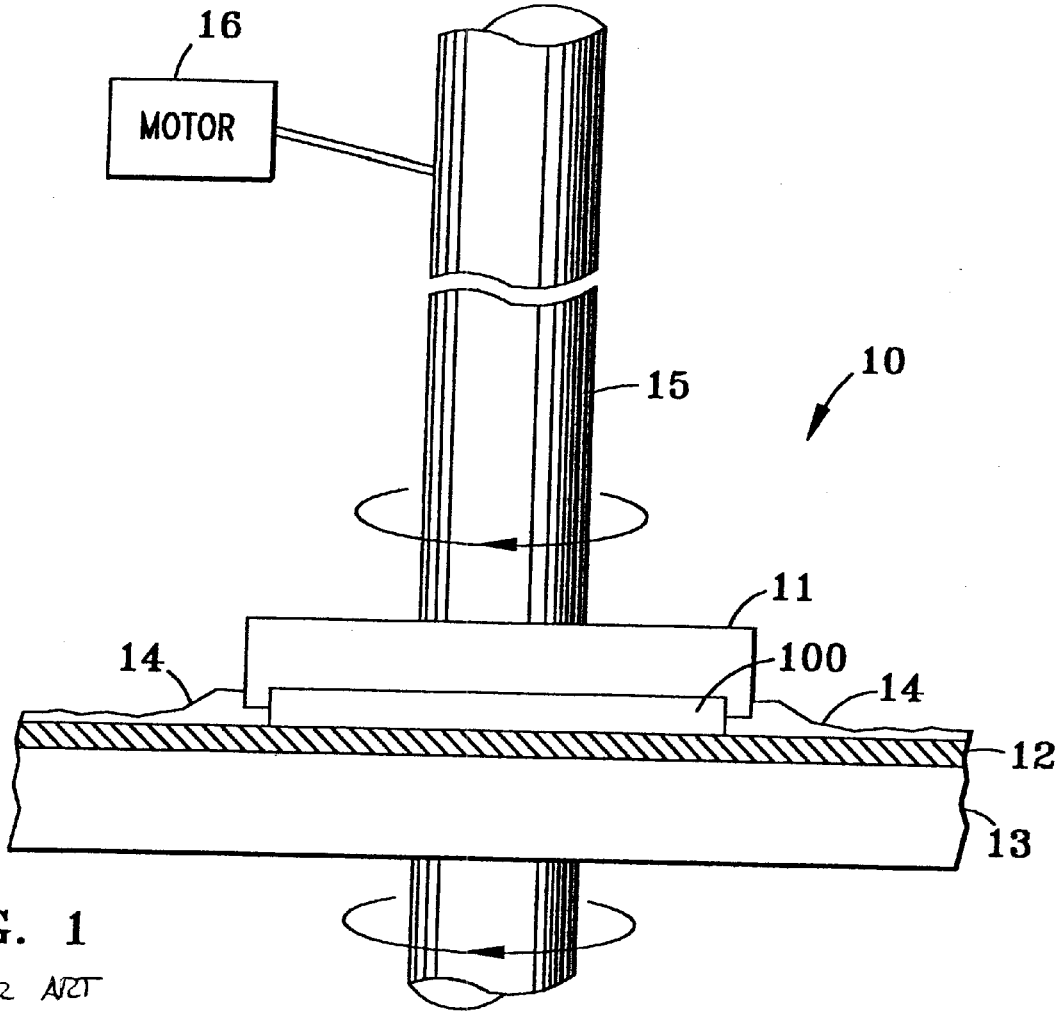
FIG. 1 PRIOR ART
FIG. 1 is a general view of a typical chemical-mechanical polishing (CMP) arrangement to which the present invention may be advantageously applied.
Figure 2A:
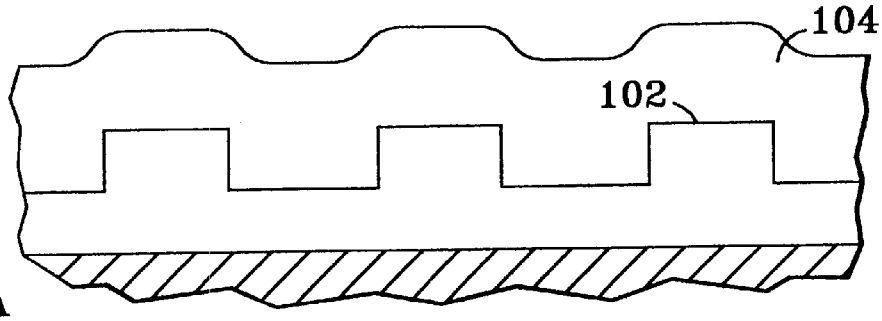
FIG. 2A PRIOR ART
FIG. 2A shows an arrangement of polycrystalline silicon and silicon dioxide films where film removal by CMP is to be performed.
Figure 2B:
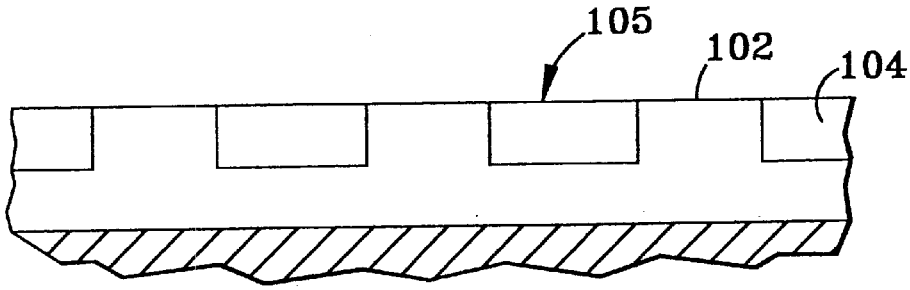
FIG. 2B PRIOR ART
FIG. 2B shows a desired result of CMP processing of the film arrangement of FIG. 2A.
Figure 3:
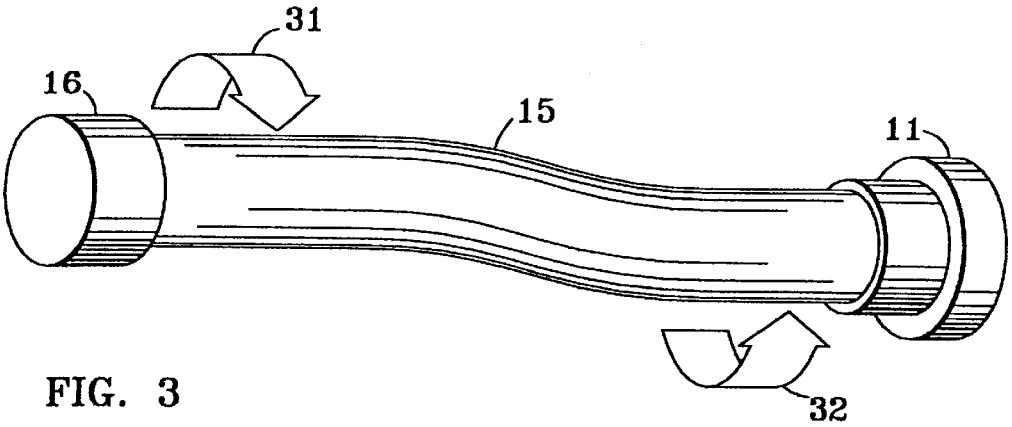
FIG. 3 is a schematic illustration of torque-induced deformation of a shaft.
Figure 4:
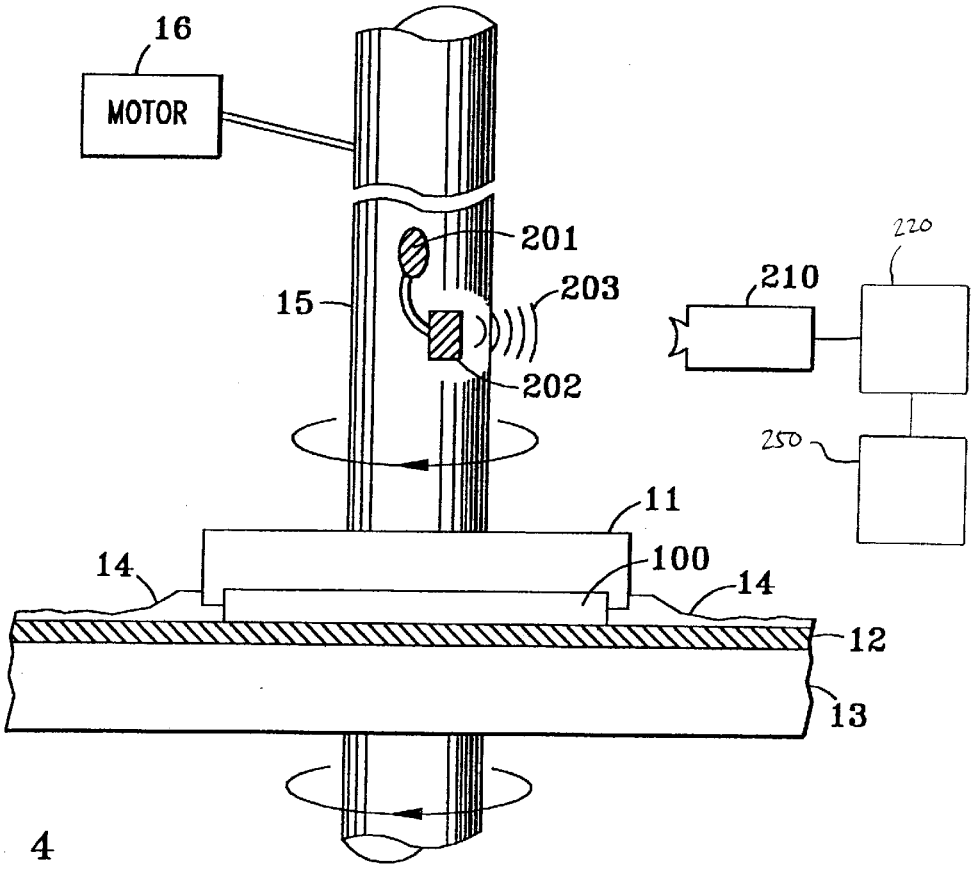
FIG. 4 shows a torque-based arrangement for monitoring the endpoint of a CMP process, using a strain gauge mounted on the shaft rotating the wafer carrier, on which the present invention may advantageously be practiced.
Figure 5A:
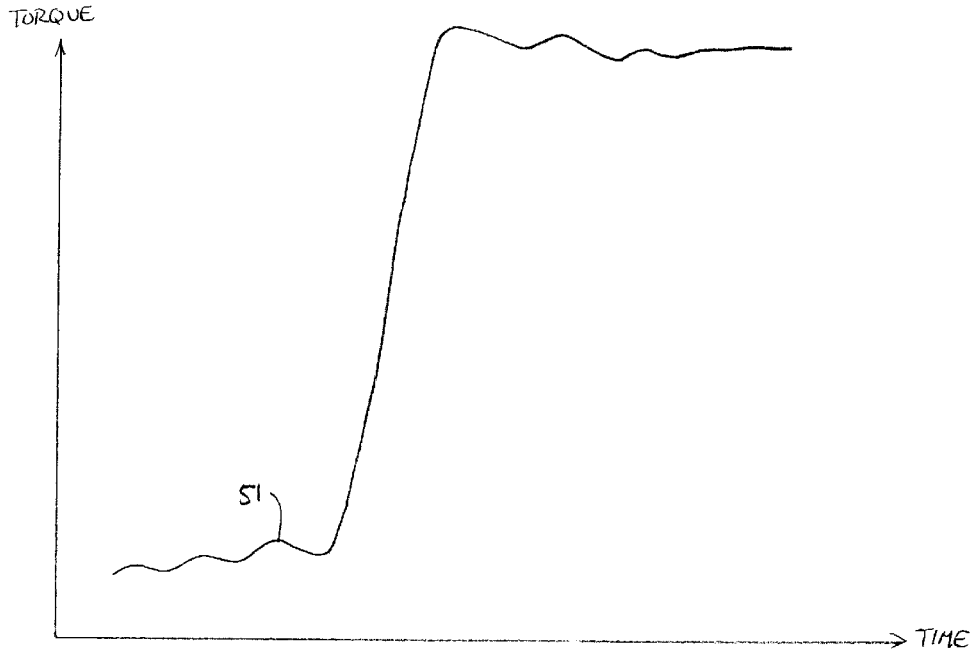
FIG. 5A PRIOR ART
FIG. 5A shows an example of a signal acquired during a CMP process, indicating the process endpoint.
Figure 5B:
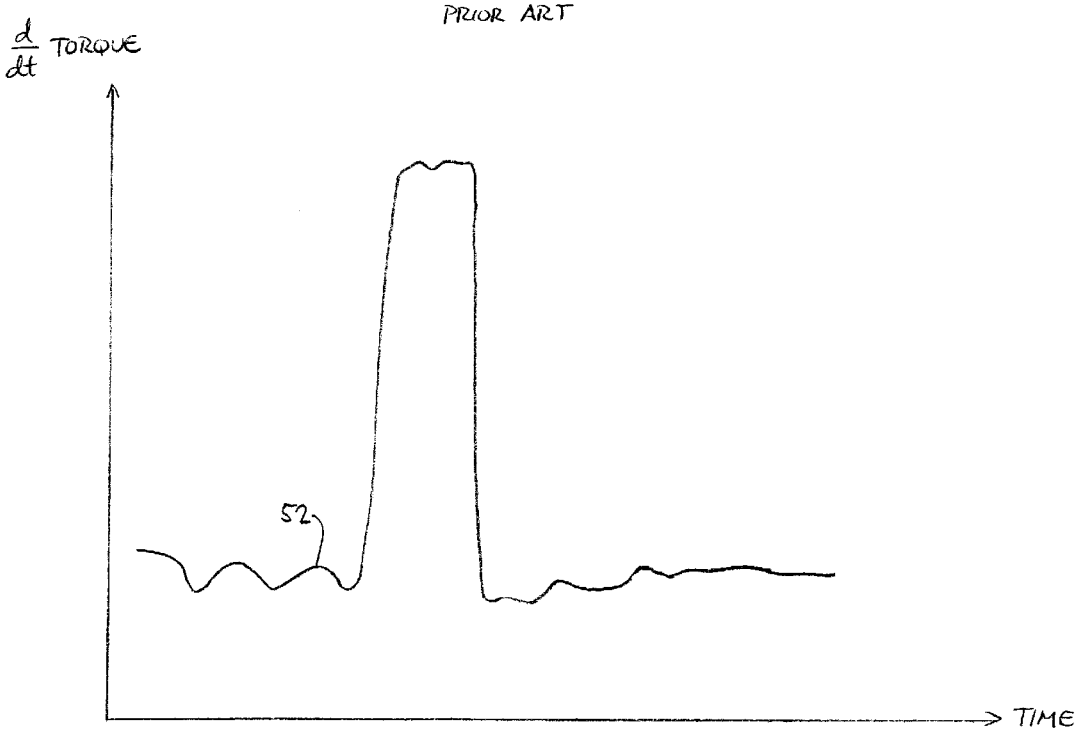
FIG. 5B PRIOR ART
FIG. 5B shows the time derivative of the signal of FIG. 5A.
Figure 6A:
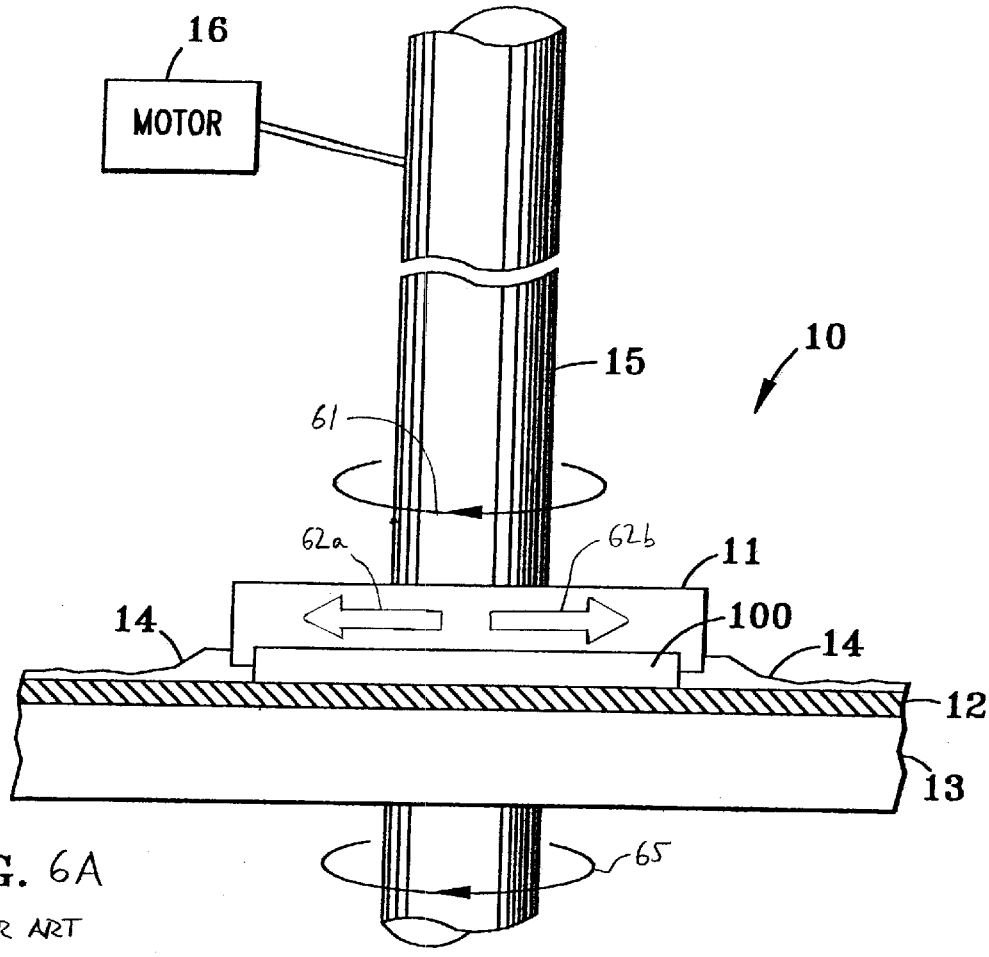
FIG. 6A PRIOR ART
FIG. 6A is a schematic illustration of rotation and oscillation of the wafer carrier.
Figure 6B:
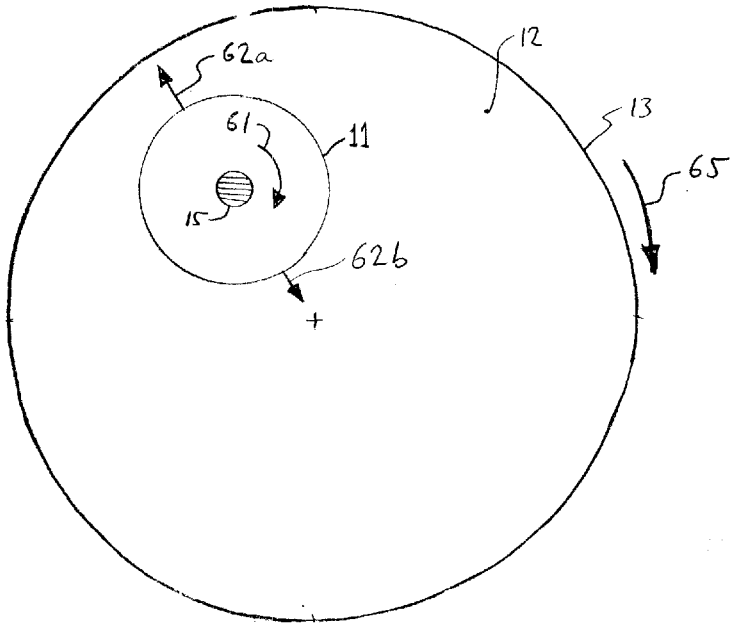
FIG. 6B PRIOR ART
FIG. 6B is a top view of FIG. 6A, showing the oscillation of the wafer carrier in a radial direction with respect to the platen.
Figure 7:
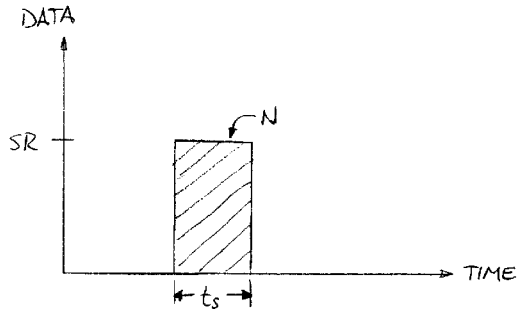
FIG. 7 illustrates acquisition of a number N of data points during time $t_s$ at a sampling rate SR.

The raw endpoint detection data from the CMP apparatus (in this embodiment, torque signals 203 from the strain gauge 201, converted to voltage signals by detector 210) is sampled at a sampling rate SR by the data analysis unit 220. As shown schematically in FIG. 7, N data points are acquired in a sampling time $t_s$ at a sampling rate SR:

$$N=SR*t_s$$

The values of the N data points, $s_i$, are then averaged to yield a single data point X:

$$X=(1/N)\sum_{i=1}^{N} s_i$$

A typical sample size N is approximately 8000 points.

The noise associated with rotation of the carrier 11 can be effectively eliminated by tuning the sampling rate SR and sample size N so that $t_s$ is approximately equal to the rotational period $T_{rot}$:

$$N/SR=t_s\approx T_{rot} \quad (1)$$

In practice, $t_s\approx T_{rot}$ if $t_s$ differs from $T_{rot}$ by 10% or less; that is, if $0.9\ T_{rot}\leqq t_s\leqq 1.1\ T_{rot}$.

If equation (1) is satisfied, the N data points are acquired during a time period approximating one complete rotation of the carrier 11. The average value X of these data points therefore remains constant if no additional change to the torque is introduced (that is, if there is no actual change in friction due to polishing of the layer on the wafer surface during the rotation).

Oscillation Noise: Tunable Moving Array Size

Figure 8A:
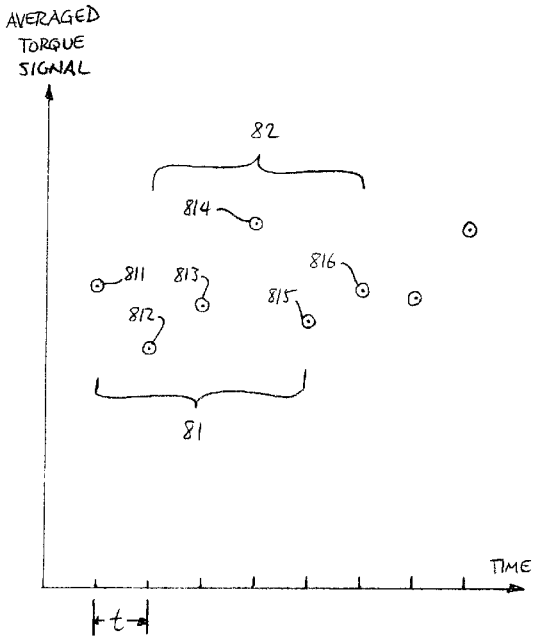
FIG. 8A shows a plot of averaged data points in moving arrays, in accordance with an embodiment of the present invention.

The average values (values of X) may be plotted as shown in FIG. 8A (points 811–816 etc.). Each point in FIG. 8A represents an average of N (about 8000) raw data points. The time interval between points in FIG. 8A (e.g. between points 811 and 812) is t, given by $$t=t_s+t_p$$

where $t_p$ is the time required for processing the N points (averaging, plotting, etc.), and is a small fraction of $t_s$.

Figure 8B:
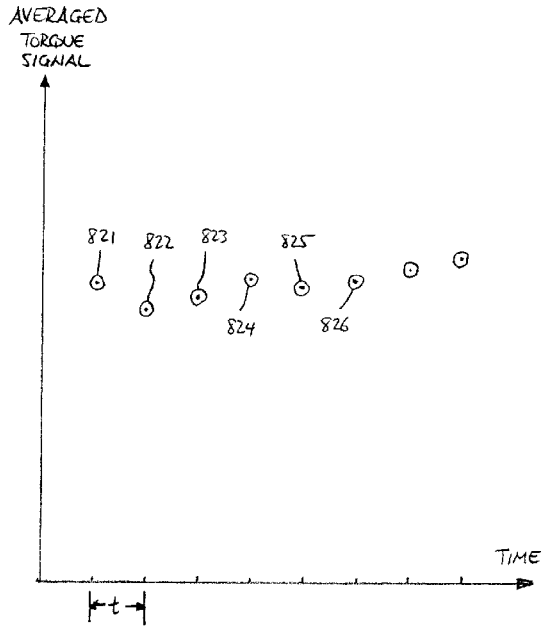
FIG. 8B shows a plot of the data points of FIG. 8A, after averaging using an adjustable moving array size, in accordance with an embodiment of the present invention.

The noise due to oscillation of the carrier (which generally is greater than noise due to rotation) is averaged out by averaging over the period of oscillation $T_{osc}$, using a moving array with a tunable array size $N_A$. Points 821–826 are plotted in FIG. 8B from points 811–816, using a moving array technique. In this example, the moving array size $N_A$ is 5. The first point 821 in FIG. 8B represents the same value as point 811. The second point 822 represents the average of 811 and 812; the third point 823 represents the average of 811, 812 and 813; the fourth point 824 represents the average of 811, 812, 813 and 814.

After 5 intervals of time t have elapsed, 5 points 811–815 (array 81) are available for averaging. Point 825 represents the average of the 5 points in array 81. After the next time interval, point 816 is plotted and a new array 82 is formed which includes the 5 points 812–816. Point 826 represents the average of array 82. In general, after $N_A$ time intervals have elapsed, the array of $N_A$ points moves with the calculation of a new value of X after each time interval, so that the array includes the $N_A$ most recent values of X. (The array may be thought of as including all the values, if fewer than $N_A$ have yet been calculated, and growing to a maximum size $N_A$). Variations in the values of X (such as those plotted in FIG. 8A) are therefore smoothed out by averaging the $N_A$ most recent values of X, and then plotting the result (as in FIG. 8B).

It will be appreciated that an array of size $N_A$ represents data acquired over a time period $N_A$*t. The noise associated with the periodic oscillation of the carrier (period $T_{osc}$) may therefore be averaged out by setting this time period approximately equal to (generally, within 10% of) an integer multiple m of $T_{osc}$:

$$T_{osc}*m\approx N_A t \quad (2)$$

Since $t\approx t_s=N/SR\approx T_{rot}$, Equation (2) may be expressed in terms of the adjustable parameters as follows:

$$T_{osc}\approx(N_A/m)(N/SR)$$

In practice, $T_{rot}$ and $T_{osc}$ may usually be adjusted within narrow limits (about 10%) without affecting the performance of the CMP process. This permits the approximations in Equations (1) and (2) to be still more closely satisfied. If N is changed to adjust t, in order to better satisfy Equation (2), then Trot should be changed to ensure that Equation (1) is still satisfied. In a typical data analysis scheme, N is adjusted while SR remains constant. $N_A$ is generally in the range of about 9 to about 36. If $N_A$ is set to too small a value, inadequate smoothing of the data results; if $N_A$ is set too large, the endpoint detection system responds too slowly to an actual change in the signal, and the resulting endpoint trace (time derivative of the average data values plotted as a function of time) is distorted.

Figure 9:
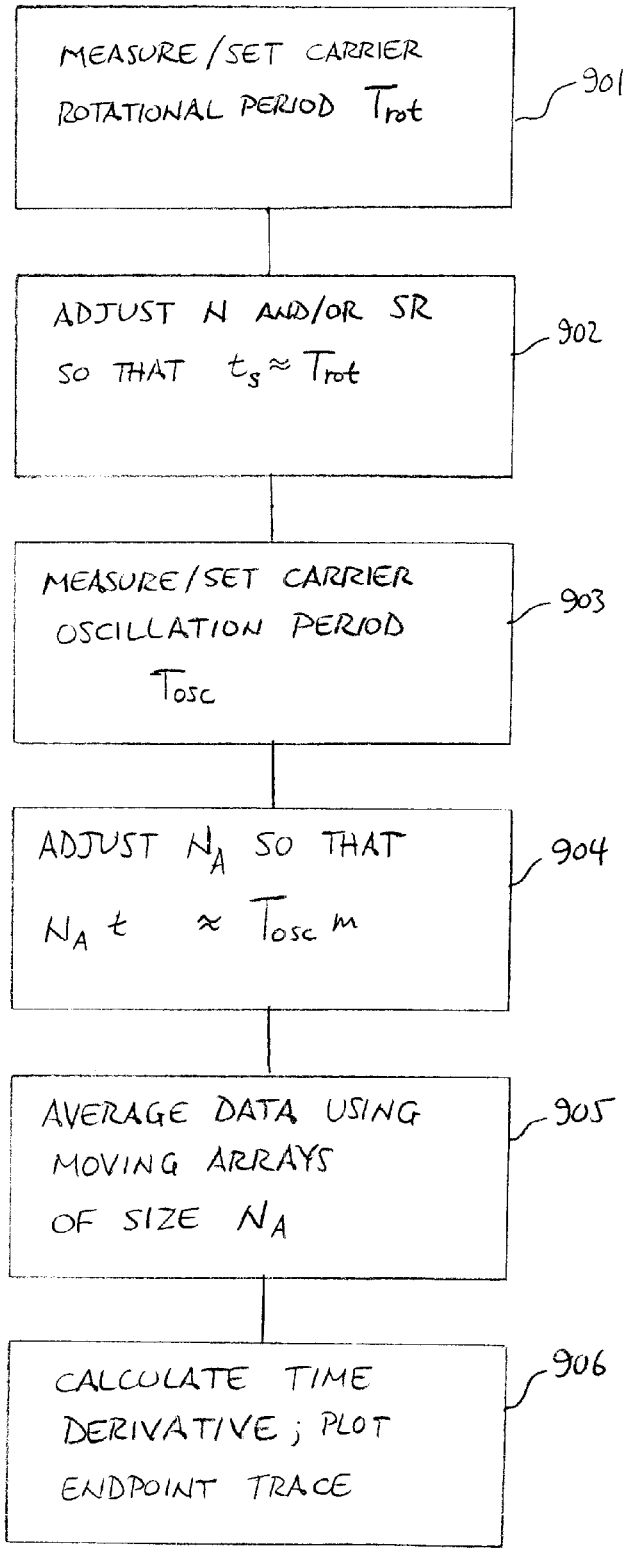
FIG. 9 is a flowchart summarizing steps in a method for noise reduction according to the present invention.

Steps in a method for implementing the above-described noise reduction technique are summarized in the flowchart of FIG. 9. The rotational period $T_{rot}$ of the carrier is established, either by measuring the rotation in an existing process or setting Trot to a convenient value (step 901). The sample size N and/or sampling rate SR are adjusted so that the sampling time $t_s$=N/SR approximately matches the rotational period $T_{rot}$ (step 902). The carrier oscillation period $T_{osc}$ is then established (step 903), and the moving array size $N_A$ and integer m are chosen so that ($N_A$*t)/m approximately matches $T_{osc}$ (step 904). The data is then averaged using moving arrays of size $N_A$ (step 905; see FIGS. 8A and 8B). Finally, as noted above, the time derivative is calculated and the endpoint trace is plotted to give a convenient process control signal which is inputted to control unit 250 (step 906).

EXAMPLE

The above-described technique may be illustrated using parameters from a CMP process presently in use. The rotation period of the carrier is 0.8 sec and the oscillation period is 2.09 sec. The sampling rate SR is 10000 points/sec; N is therefore set to 8000, so that $t_s$=N/SR=0.8 sec=$T_{rot}$. From an examination of the data file, it is found that t=0.93 sec. Accordingly, $N_A$/m should be chosen to approximate $T_{osc}$/t=2.247. This may be done by setting $N_A$=9, m=4.

Figure 10A:
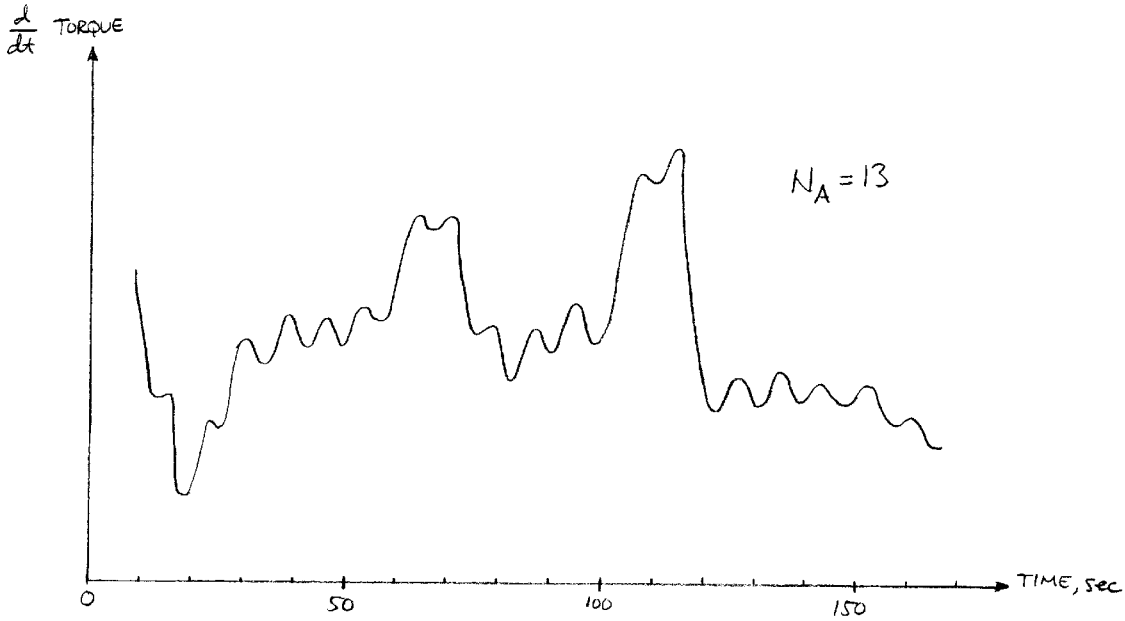
FIG. 10A is an example of an endpoint detection trace, where the moving array size $N_A$ is set to 13.
Figure 10B:
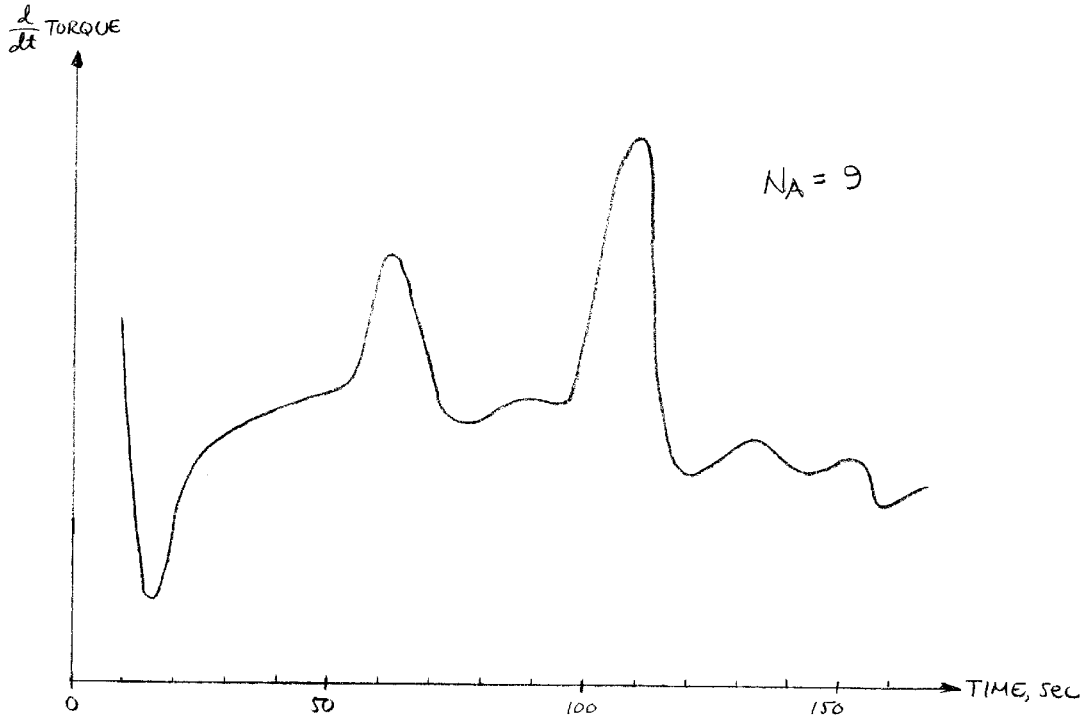
FIG. 10B shows an endpoint detection trace using the same raw data as in FIG. 10A, where the moving array size $N_A$ is set to 9.

FIGS. 10A and 10B each show an endpoint trace using data from this example, with different values of the array size $N_A$. In FIG. 10A, $N_A$=13, so that noise due to carrier oscillation is not averaged out; periodic variations in the endpoint signal may be easily seen. In FIG. 10B, $N_A$=9, so that noise due to carrier oscillation is effectively removed.

It is noteworthy that, as shown in this example, a larger value of the moving array size does not generally give better smoothing of the endpoint trace. This is an unexpected result in view of the general rule that the signal-to-noise ratio increases according to the square root of the array size.

This noise reduction technique is also applicable to CMP endpoint detection units using motor current measurements, since periodic variations in polishing friction will lead to periodic variations in the motor current.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. A method for reducing noise in an endpoint detection system in a chemical-mechanical polishing (CMP) apparatus, the apparatus including a polishing pad and a workpiece carrier connected to a shaft, the carrier rotating in accordance with rotation of the shaft and oscillating with respect to the polishing pad, the endpoint detection being performed according to measurements associated with friction between the polishing pad and the workpiece, the method comprising the steps of:

computing, in a first computing step, a plurality of values at a predetermined time interval, each of the values being an average of a plurality of said measurements performed in a time period approximately equal to a rotation period of the carrier;

forming an array of successive values computed in said first computing step, the array being characterized as a moving array including the most recently computed value, the array having a size such that a product of the moving array size and the time interval is approximately an integral multiple of an oscillation period of the carrier; and computing, in a second computing step, an average of the values in the array to obtain an array average at each successive time interval.

2. A method according to claim 1, wherein the measurements are performed at a sampling rate, and said first computing step further comprises the steps of:

establishing the rotation period of the carrier; and setting at least one of the sampling rate and a number of the measurements so that a sampling time for performing the measurements approximates the rotation period.

3. A method according to claim 2, wherein said establishing step comprises adjusting the rotation period.

4. A method according to claim 1, wherein said step of forming the array further comprises the step of establishing the oscillation period of the carrier.

5. A method according to claim 4, wherein said establishing step comprises adjusting the oscillation period.

6. A method according to claim 1, wherein the array includes all of the computed values when the number of computed values does not exceed the moving array size.

7. A method according to claim 1, further comprising the steps of:

computing a plurality of successive array averages;

plotting said successive array averages to obtain a function of time; and computing the derivative of said function with respect to time to obtain an endpoint signal.

8. A method according to claim 7, wherein the endpoint detection system includes a controller for controlling the CMP apparatus, and further comprising the step of inputting the endpoint signal to the controller.

9. A method according to claim 1, wherein the moving array size is in the range of about 9 to about 36.

10. A method according to claim 1, wherein the measurements comprise measurements of torque on a shaft.

11. A method according to claim 1, wherein the measurements comprise measurements of current in a motor used to drive the shaft.

12. A computer-readable storage medium having stored therein instructions for performing a chemical-mechanical polishing (CMP) endpoint detection method comprising the steps of:

computing, in a first computing step, a plurality of values at a predetermined time interval, each of the values being an average of a plurality of measurements associated with friction between a CMP polishing pad and a workpiece being polished, the measurements being performed in a time period approximately equal to a rotation period of the workpiece;

forming an array of successive values computed in said first computing step, the array being characterized as a moving array including the most recently computed value, the array having a size such that a product of the moving array size and the time interval is approximately an integral multiple of an oscillation period of the workpiece; and computing, in a second computing step, an average of the values in the array to obtain an average at each successive time interval.

13. A computer-readable storage medium according to claim 12, wherein the measurements are performed at a sampling rate, and said first computing step further comprises the steps of:

establishing the rotation period of the workpiece; and setting at least one of the sampling rate and a number of the measurements so that a sampling time for performing the measurements approximates the rotation period.

14. A computer-readable storage medium according to claim 12, wherein said step of forming the array further comprises the step of establishing the oscillation period of the workpiece.

15. A computer-readable storage medium according to claim 12, wherein the array includes all of the computed values when the number of computed values does not exceed the moving array size.

16. A computer-readable storage medium according to claim 12, wherein the method further comprises the steps of:

computing a plurality of successive array averages;

plotting said successive array averages to obtain a function of time; and computing the derivative of said function with respect to time to obtain an endpoint signal.

* * * * *